US012129098B2

(12) United States Patent
Caleman, Jr.

(10) Patent No.: US 12,129,098 B2
(45) Date of Patent: Oct. 29, 2024

(54) OVENABLE PACKAGE

(71) Applicant: AMCOR FLEXIBLES NORTH AMERICA, INC., Neenah, WI (US)

(72) Inventor: Reinaldo Caleman, Jr., Neenah, WI (US)

(73) Assignee: AMCOR FLEXIBLES NORTH AMERICA, INC., Neenah, WI (US)

( * ) Notice: Subject to any disclaimer, the term of this patent is extended or adjusted under 35 U.S.C. 154(b) by 667 days.

(21) Appl. No.: 17/295,689

(22) PCT Filed: Nov. 20, 2018

(86) PCT No.: PCT/US2018/061938

§ 371 (c)(1),
(2) Date: May 20, 2021

(87) PCT Pub. No.: WO2020/106275

PCT Pub. Date: May 28, 2020

(65) Prior Publication Data

US 2022/0009698 A1 Jan. 13, 2022

(51) Int. Cl.
*B65D 81/34* (2006.01)
*B65D 75/58* (2006.01)

(52) U.S. Cl.
CPC ..... *B65D 81/343* (2013.01); *B65D 75/5805* (2013.01); *B65D 2203/02* (2013.01)

(58) Field of Classification Search
CPC ..... B65D 81/343; B65D 75/5805; B65D 2203/02
USPC ..... 426/113
See application file for complete search history.

(56) References Cited

U.S. PATENT DOCUMENTS

| | | | | |
|---|---|---|---|---|
| 4,923,701 | A | 5/1990 | VanErden | |
| 5,660,479 | A | 8/1997 | May et al. | |
| 6,245,367 | B1 * | 6/2001 | Galomb | B65D 75/008 206/541 |
| 7,261,468 | B2 | 8/2007 | Schneider et al. | |
| 2005/0286812 | A1 * | 12/2005 | Sprague | B65D 33/2508 383/203 |
| 2007/0104395 | A1 | 5/2007 | Kinigakis et al. | |
| 2009/0159483 | A1 * | 6/2009 | Hinze | B65D 75/527 206/460 |
| 2010/0021093 | A1 | 1/2010 | Plourde et al. | |
| 2014/0339105 | A1 | 11/2014 | Czarny et al. | |

FOREIGN PATENT DOCUMENTS

WO 2016207587 A1 12/2016

OTHER PUBLICATIONS

PCT International Search Report, international application No. PCT/US2018/061938, issued Feb. 8, 2019, 3 pages.

* cited by examiner

*Primary Examiner* — Brent T O'Hern

(57) ABSTRACT

Described are ovenable or cook-in packages that maintain a hermetic seal. The packages include an information-laden header portion, a product portion that includes the hermetic seal and a line of weakness. The information-laden header portion is removably connected to the product portion by the line of weakness. The hermetic seal is maintained after the information-laden header portion is removed from the product portion.

18 Claims, 6 Drawing Sheets

OVENABLE PACKAGE

TECHNICAL FIELD

The present disclosure relates to ovenable or cook-in packages that include a hermetic seal and a removable header.

BACKGROUND

Ovenable or cook-in packages provide convenience to end users. Ovenable or cook-in packages include seals (heat, ultrasonic, etc.) that should withstand elevated temperatures, for example, of up to about 55-100 degrees Celsius (131-212 degrees Fahrenheit) or higher, for example, 218 degrees Celsius (425 degrees Fahrenheit), for periods of time, such as from seconds to about a minute, from minutes to about 60 minutes, from 1 hour to 24 hours, or from a day to several days, in environments which may range from heated air (humidified or not) to steam to submersion in heated water. For example, in a sous vide application, the period of time can go over 24 hours; or when heating in a microwave, the period of time can be from less than a minute to several minutes. The packages typically contain food that remains in the package through the cooking cycle. Packages are hermetically sealed to aid in preserving the contents and ensuring that the contents cook properly. The cooking cycle can involve apparatuses for example, a stove top, an oven or a microwave. The cooking mechanism can be provided through baking, boiling, heating, etc. The contents, or food, is in a package that may include a formed film, such as a rigid or semi-rigid tray, and a non-formed film that is a lid to the formed portion. In other examples, the food may be packaged in a completely non-formed film package.

Current packages may include a paperboard or cellulose-containing portion in the form of a label, a sleeve, a backing portion or a carton that is adhered to or placed around the film package. The paperboard portion typically includes printed information regarding ingredients and/or cooking instructions. A drawback associated with the paperboard portion is that it occludes the contents of the package to some degree. This can be problematic such that an end user cannot see the contents of the package when making a purchase decision. Another drawback is that the paperboard portion needs to be removed from the package before use in the cooking apparatus to prevent the risk of fire as the paperboard portion can be flammable. A further drawback is that when the paperboard portion is removed, it can easily become wet in the food preparation area such that the instructions are no longer readable. In other instances, the paperboard portion can be disposed of such that the user must rummage through the garbage if they need to refer to the instructions during the cooking cycle. Another drawback is that the forces necessary to remove the paperboard portion from the package can unintentionally break the hermetic seal or tear the film portion of the package. Furthermore, paperboard portions increase the cost of the package.

Some ovenable or cook-in packages have the ingredients, cooking instructions or graphics printed on the film in a portion of the package that overlies the contents. This also occludes the contents of the package to some degree.

There is a need to provide improved ovenable or cook-in packages that address the aforementioned concerns.

SUMMARY

The present application describes an ovenable package that keeps the printed information intact, provides an unoccluded view of the food product and maintains a hermetic seal during the cooking cycle.

In one embodiment, the ovenable package includes an information-laden header portion, a product portion that includes a hermetic seal and a line of weakness. The information-laden header portion is removably connected to the product portion by the line of weakness. The hermetic seal is maintained after the information-laden header portion is removed from the product portion.

Other features that may be used individually or in combination with respect to any embodiment are as follows.

The ovenable package may include that the line of weakness is composed of perforations.

The ovenable package may include that the line of weakness is positioned in the hermetic seal.

The ovenable package may include that the product portion is substantially transparent.

The ovenable package may include that the information-laden header portion includes indicia. The indicia may be printed indicia. The indicia may include instructions that are to be executed during the cooking cycle.

The ovenable package may be thermoformed.

The ovenable package can include a product that is enclosed within the product portion. The product includes a food product.

In another embodiment, an ovenable package includes a first sidewall that includes film, a second sidewall that includes film, an information-laden header portion that includes indicia, a product portion that includes a hermetic seal, and a line of weakness. The first sidewall and the second sidewall are sealed to each other near the periphery of the exposed edges of the sidewalls in at least the product portion. The information-laden header portion is removably connected to the product portion by the line of weakness. The hermetic seal is maintained after the information-laden header portion is removed from the product portion.

Other features that may be used individually or in combination with respect to the embodiment are as follows.

The first sidewall and the second sidewall may be the same type of film as each other. The first sidewall and the second sidewall may be different types of film from each other.

In a further embodiment, the ovenable package includes a first sidewall that includes a non-formable film, a second sidewall that includes a formable film, an information-laden header portion that includes indicia, a product portion that includes a hermetic seal, and a line of weakness. The first sidewall and the second sidewall are sealed to each other near the periphery of the exposed edges of the sidewalls in at least the product portion. The information-laden header portion is removably connected to the product portion by the line of weakness. The product portion is substantially transparent. Further, the hermetic seal is maintained after the information-laden header portion is removed from the product portion.

BRIEF DESCRIPTION OF THE DRAWINGS

Other objects and advantages of the present disclosure will become more apparent to those skilled in the art in view of the following description and the accompanying figures.

Figure 1A:
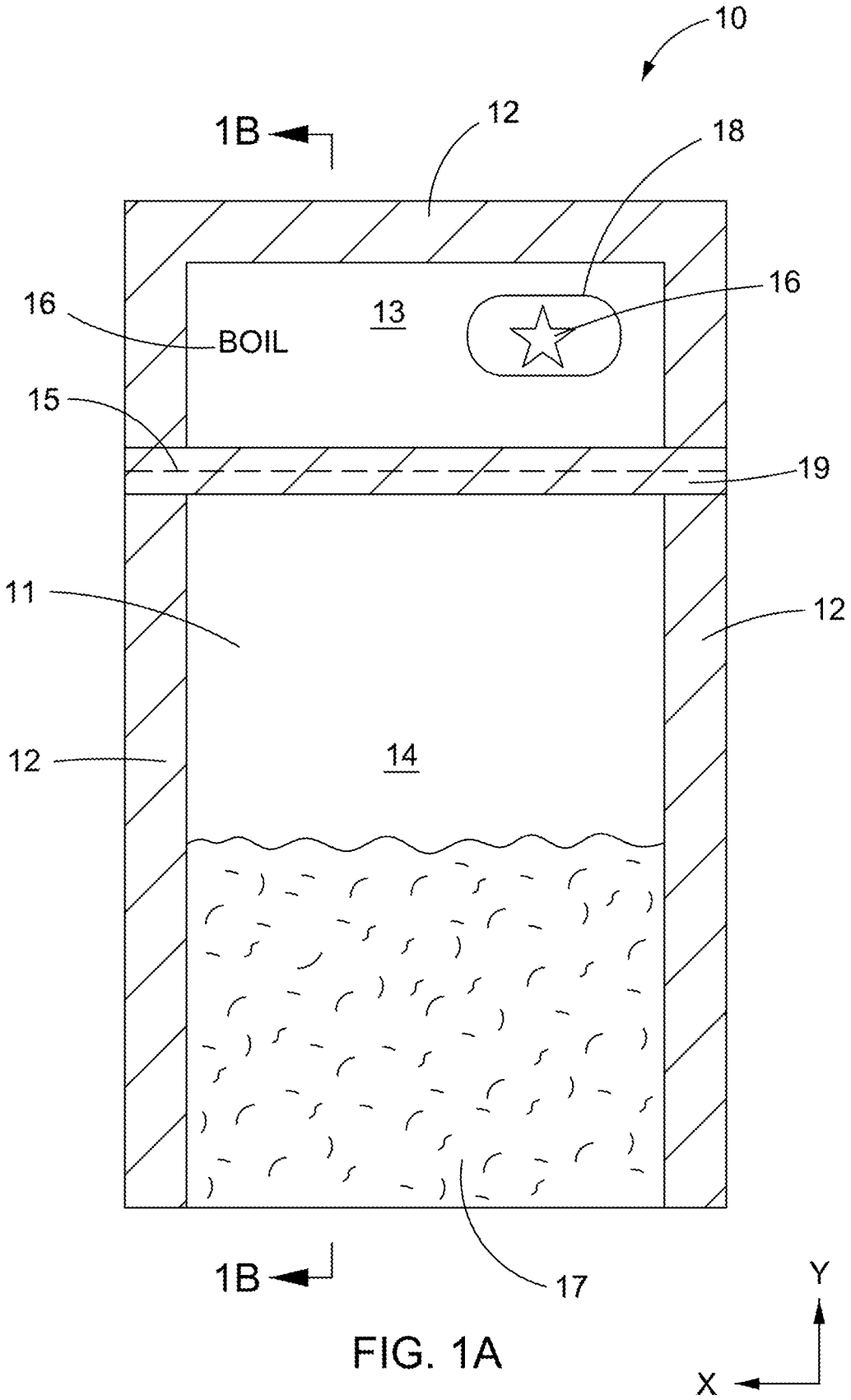
FIG. 1A illustrates a schematic top view of an embodiment of an ovenable package that is in the form of a bag.

The figures show some but not all embodiments. The figures are not necessarily to scale. Like numbers used in the figures refer to like components. It will be understood, however, that the use of a number to refer to a component in a given figure is not intended to limit the component in another figure labeled with the same number.

DETAILED DESCRIPTION

An ovenable or cook-in package is described herein. The package may be made from polymer film and includes an information-laden header portion, a product portion that includes a hermetic seal, and a line of weakness. The header portion is removably connected to the product portion by the line of weakness. The hermetic seal is maintained after the header portion is removed from the product portion. The hermetic seal can provide for extended storage and, in some cases, for proper cooking of the product within the product portion. The product portion can contain a product such as a food product.

The package may include one sidewall of polymer film. The film may be a monolayer film or a multilayer film. The film may be formable film, non-formable film, shrinkable film, or non-shrinkable film as are generally known by a person of ordinary skill in the art. The film may include an oxygen barrier and/or a moisture barrier depending on the desired needs of the package. The film may further include processing additives or be blended with other materials, such as, but not limited to pigments, etc. The film includes a sealant component that allows the film to be sealed to itself or to another film. The package should be hermetically sealed. The seals may also be peelable. The film must be able to withstand ovenable or cook-in conditions that include elevated temperatures up to about 55-218 degrees Celsius or higher for extended periods of time, such as from seconds to 48 hours or more in cooking cycles that can include baking, roasting, steaming, boiling, microwave cooking, sous vide, etc. For the purposes of this disclosure, the terms "ovenable" and "cook-in" are intended to include the same conditions.

The term "sidewall", as used herein, refers to at least one layer of polymer film that is sealed to itself or another sidewall to form an enclosure.

The term "polymer", as used herein, refers to the product of a polymerization reaction, and is inclusive of homopolymers, copolymers, terpolymers, etc. In general, the layers of a film can consist essentially of a single polymer, or can have still additional polymers together therewith, i.e., blended therewith.

The term "film", as used herein refers to a polymeric web of any thickness. The polymeric web may be flexible, semi-rigid or rigid. The polymeric web is ovenable or can withstand cook-in conditions.

The term "layer", as used herein, refers to a structure of a single polymer-type or a blend of polymers that may be accompanied by additives and that may be continuous or discontinuous.

The term "multilayer", as used herein, refers to a plurality of layers in a single film structure generally in the form of a sheet or web that can be made from a polymeric material or a non-polymeric material bonded together by any conventional means known in the art (i.e., coextrusion, lamination, coating or a combination of such). The sidewall described in the present application may include a multilayer film including as many layers as desired.

The terms "formable" or "thermoformed", as used herein, refer to polymeric film that is permanently formed into a desired shape by the application of a differential pressure between the film or sheet and a mold, by the application of heat, by the combination of heat and the application of a differential pressure between the film or sheet and a mold, or by any thermoforming technique known to those skilled in the art The term "non-formable", as used herein, refers to polymeric film that is flexible and not permanently formed into a shape by any thermoforming technique.

The term "shrinkable" as used herein, refers to shrinkage of greater than 5 percent in either the transverse or machine direction of the film.

The term "non-shrinkable" as used herein, refers to shrinkage of 5 percent or less in either the transverse or machine direction of the film.

The term "shrinkage" as used herein, refers to the use of a polymeric, packaging is film manufactured in such a way that when it is exposed to a certain amount of heat, the film will contract in at least one direction along its length (machine direction) or width (transverse direction), preferably in both directions, reducing its overall surface area. Shrinkage values are obtained by measuring unrestrained shrink of a 10 cm square specimen immersed in a water bath. Four test specimens are cut from a given sample of the film to be tested. Specimens are cut into squares of 10 cm in the machine direction (MD) of the film by 10 cm in the transverse direction (TD) of the film. Each specimen is completely immersed for 5 seconds in a 90 degrees Celsius water bath. The specimen is removed from the bath and the distance between the ends of the shrunken specimen is measured for both the MD and TD of the film specimen. The difference in the measured distance for the shrunken specimen and each original 10 cm side is multiplied by ten to obtain the percent of shrinkage for the specimen for each direction. The MD shrinkage for the four specimens is averaged for the MD shrinkage value and the TD shrinkage for the four specimens is averaged for the TD shrinkage value.

The term "oxygen barrier", as used herein, refers to a material to limit or slow the ingress oxygen. Packaging that includes an oxygen barrier can prevent a product from degrading a product prematurely.

The term "moisture barrier", as used herein, refers to a material to limit or slow the product from drying out. Packaging that includes a moisture barrier can prevent a product from losing moisture content.

The terms "processing aids" or "processing additives", as used herein, refer to anti-block agents, slip agents, stabilizing agents, release agents, lubricating agents, anti-oxidants, photo-initiators, primers, colorants, oxygen scavengers, and other additives known to and used by a person of ordinary skill in the art without undue experimentation.

The term "seal", as used herein, refers to the union of a surface (or portion thereof) of one film to a surface (or portion thereof) of another film or two different portions of a surface of the same film. A seal may be formed by any known method including heat sealing, ultrasonic sealing, RF welding, etc.

The terms "hermetic seal" or "hermetically sealed", as used herein, refer to a seal that is maintained against the flow of air or fluid, in other words, an airtight or liquid proof seal.

The terms "peelable seal" and like terminology, as used herein, refer to a seal which is engineered to be readily peelable without uncontrolled or random tearing or rupturing the packaging materials which may result in premature destruction of the package and/or inadvertent contamination or spillage of the contents of the package. A peelable seal is one that can be manually peeled apart to open the package at the seal without resort to a knife or other implement to tear or rupture the package. In the present disclosure, the peelable seal must have a seal strength sufficient to prevent failure of the seal during the packaging process and further normal handling and transport of the packaged article. The peelable seal strength must also be low enough to permit manual opening of the seal. A peelable seal may have an average peelable seal strength of less than 2,500 grams for a one inch (25.4 cm) strip or less than 1,500 grams for a one inch strip or about 500 grams to about 1,000 grams for a one inch strip. Seal parameters such as choice of materials and sealing conditions can be used to adjust the peelable seal strength to the desired level for the particular package and application.

The terms "food" or "food product", as used herein, refer to whole foods, such as for example, meat, fruits, vegetables, grains, etc., processed foods, liquid, broth, or any item that provides hydration, or nutritional or caloric value to an end user.

Before describing several exemplary embodiments of the disclosure, it is to be understood that the disclosure is not limited to the details of construction or process steps set forth in the following description. The disclosure is capable of other embodiments and of being practiced or being carried out in various ways.

Figure 1B:
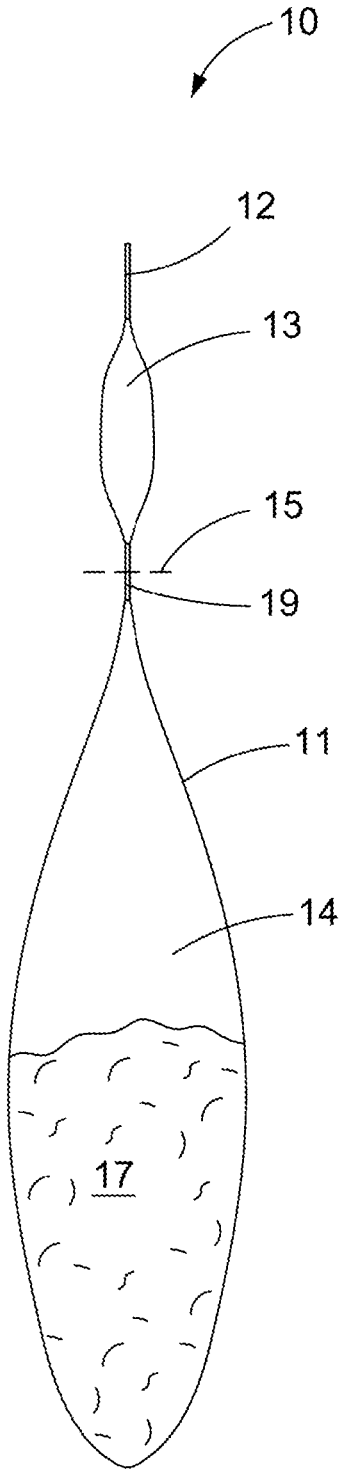
FIG. 1B illustrates a cross-section view of the ovenable package shown in FIG. 1A.

With reference to FIGS. 1A and 1B, the ovenable package 10 includes a sidewall 11 and the ovenable package 10 is shown in the form of a bag. The package 10 is shown to be rectangular and includes an X direction and a Y direction. FIG. 1B is a cross-sectional view along line 1B-1B of the ovenable package 10 that is illustrated in FIG. 1A. The sidewall 11 is sealed to itself at or near its exposed edges with edge seals 12 that can be hermetic. The ovenable package 10 includes an information-laden header 13 and a product portion 14. The information-laden header 13 is removably connected to the product portion 14 by a line of weakness 15. The line of weakness 15 may be formed by a score line, perforations (intermittent cuts that are partially or fully cut through the sidewall 11), etc., with a knife or laser or other such means as is known by one skilled in the art. The line of weakness 15 may be of any pattern and is shown to be linear in FIG. 1A. In the embodiment illustrated in FIGS. 1A and 1B, the package 10 is formed with the exposed edges being coextensive with each other such that the information-laden header 13 includes two layers of the sidewall 11. In another embodiment that is not shown, the package 10 may be formed with the exposed edges not being coextensive with each other such that the information-laden header 13 includes one layer of the sidewall 11.

The sidewall 11 may be opaque, transparent or have varying degrees thereof. For example, any portion of the sidewall 11 may be colorant-free, substantially colorant-free, metal-free, substantially metal-free, or substantially free of an additive or other material that would obscure the passage of light. A substantially transparent sidewall 11 allows a user of the ovenable package 10 to clearly view a product 17 that is enclosed within the product portion 14.

The information-laden header 13 includes indicia 16, for example, the ingredients, nutritional information, and/or instructions that are to be executed during the cooking cycle for the product 17 that may be contained within the product portion 14. The information-laden header 13 may also include indicia 16 such as patterns, graphics or branding information. Indicia 16 may be any shape, alphanumeric character, photograph, etc. The indicia 16 on the information-laden header 13 may be printed, etched or embossed onto or into the information-laden header 13. The indicia 16 can also be placed onto the header 13 by means of a label or sticker 18 that includes the indicia 16. The label or sticker 18 may be made from an ovenable material. The indicia 16 on the information-laden header 13 of the ovenable package 10 illustrated in FIG. 1A include the word "BOIL" and the shape of a star. The product portion 14 may be free from indicia 16.

The product portion 14 includes a hermetic seal 19 that is in the X direction and positioned between the edges of the ovenable package 10 in the Y direction. The hermetic seal 19 may be positioned in the Y direction of the product portion 14 in any appropriate location with respect to the product 17 that may be contained in the product portion 14. That is, the hermetic seal 19 of the product portion 14 may touch the line of weakness 15 or be positioned as close to or as far away from the line of weakness 15 as desired for the given packaged product 17. The hermetic seal 19 may be of any shape and may be generally parallel to the line of weakness 15. The hermetic seal 19 of the package of FIGS. 1A and 1B is shown as being linear and parallel to the line of weakness 15.

Figure 1C:
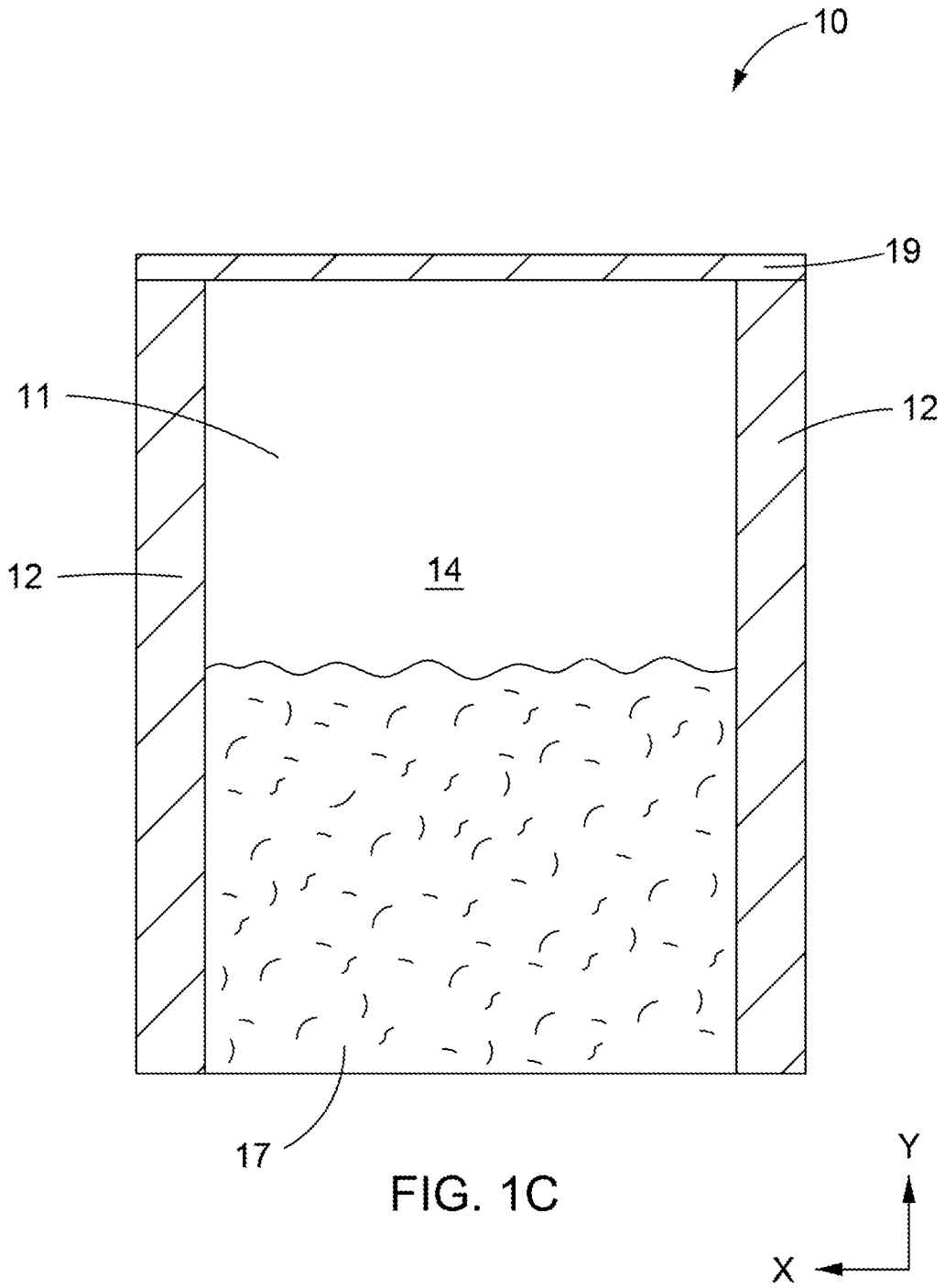
FIG. 1C illustrates a schematic top view of the ovenable package shown in FIG. 1A with a removable portion of the package removed.

The hermetic seal 19 is maintained after the ovenable package 10 has been manipulated or had force applied to it in order to remove the information-laden header 13 from the product portion 14. As such, the product 17 remains protected from the environment that is outside of the ovenable package 10. The product 17 may be a food product. The product 17 will cook properly if hermeticity is required for cooking. FIG. 1C shows the ovenable package 10 with the information-laden header 13 removed.

The disclosure is not limited to the embodiment illustrated in FIGS. 1A-1C. For example, in another embodiment, the sidewall 11 may be folded such that the ovenable package 10 may include a gusset and be in the form of a stand-up pouch (SUP). Further, the edge seals 12, the line of weakness 15, the header 13, the product portion 14, and the hermetic seal 19 may appear to be positioned in different X or Y directions for another package with respect to the orientation of that package. For example, an edge seal 12 in the X direction is shown as a portion of the header 13 in FIGS. 1A and 1B, where in another embodiment, an edge seal 12 in the X direction may be a portion of the product portion 14. In another example, where the ovenable package 10 is formed by a form-fill-seal process (FFS), the information-laden header 13 and the product portion 14 may each include an edge seal 12.

Figure 2A:
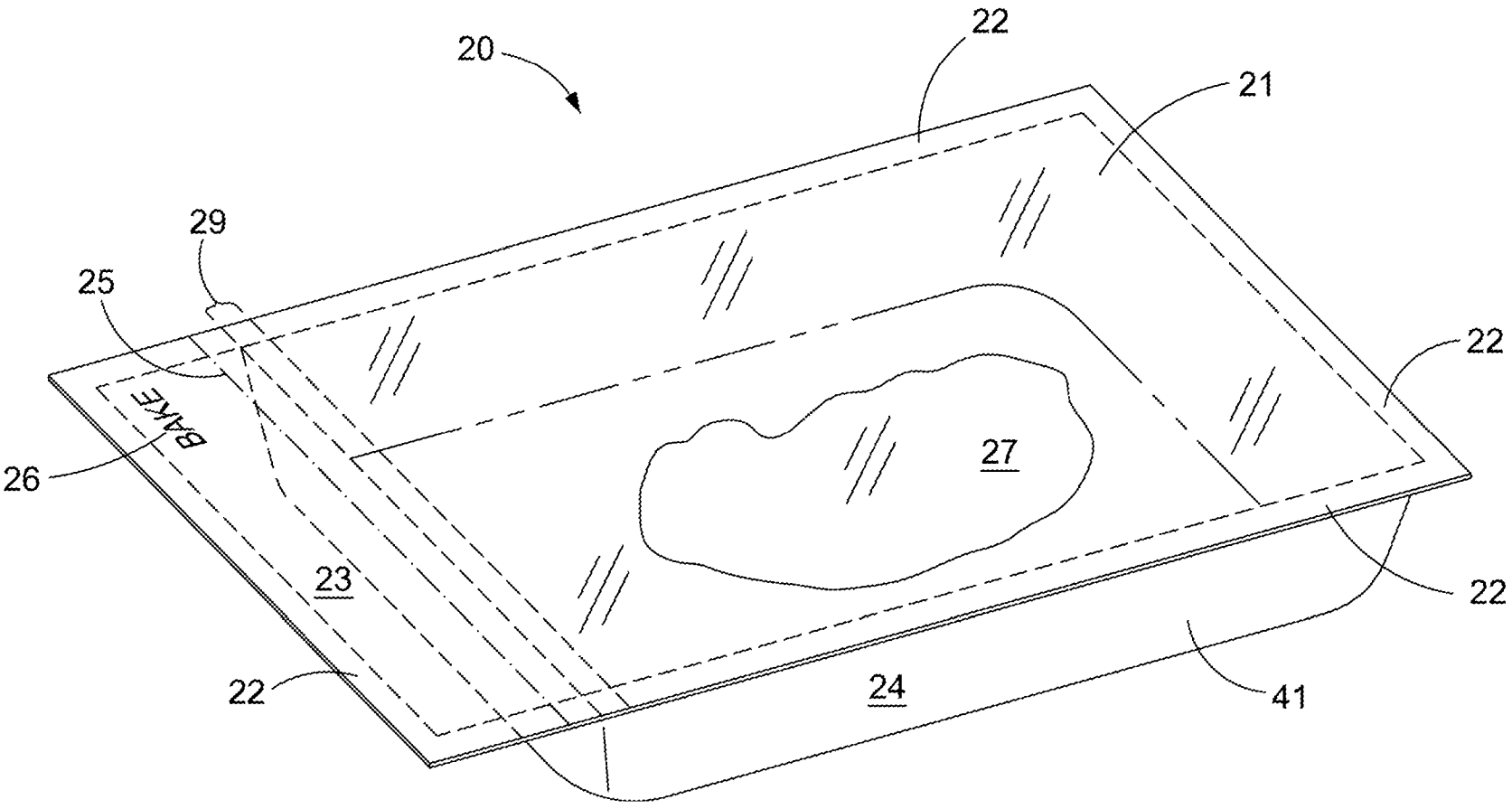
FIG. 2A illustrates a perspective view of another embodiment of an ovenable package.

In another embodiment, the ovenable package 20 may have a first sidewall 21 and a second sidewall 41. With reference to FIG. 2A, the first sidewall 21 is shown as a non-formed film lid that is connected to the second sidewall 41 that is shown as a thermoformed film tray. The first sidewall 21 is attached to the second sidewall 41 by edge seals 22 about the periphery of the exposed edges of each sidewall 21 and 41. In the embodiment illustrated in FIG.

2A, the edges of the first sidewall 21 and the edges of the second sidewall 41 are shown to be coextensive with each other such that an information-laden header 23 includes the first and second sidewall 21 and 41. In another embodiment of the package 20 that is not shown, the edges of the first sidewall 21 and the edges of the second sidewall 41 may not be coextensive with each other such that the information-laden header 23 includes only the first or second sidewall 21 or 41.

Figure 2B:
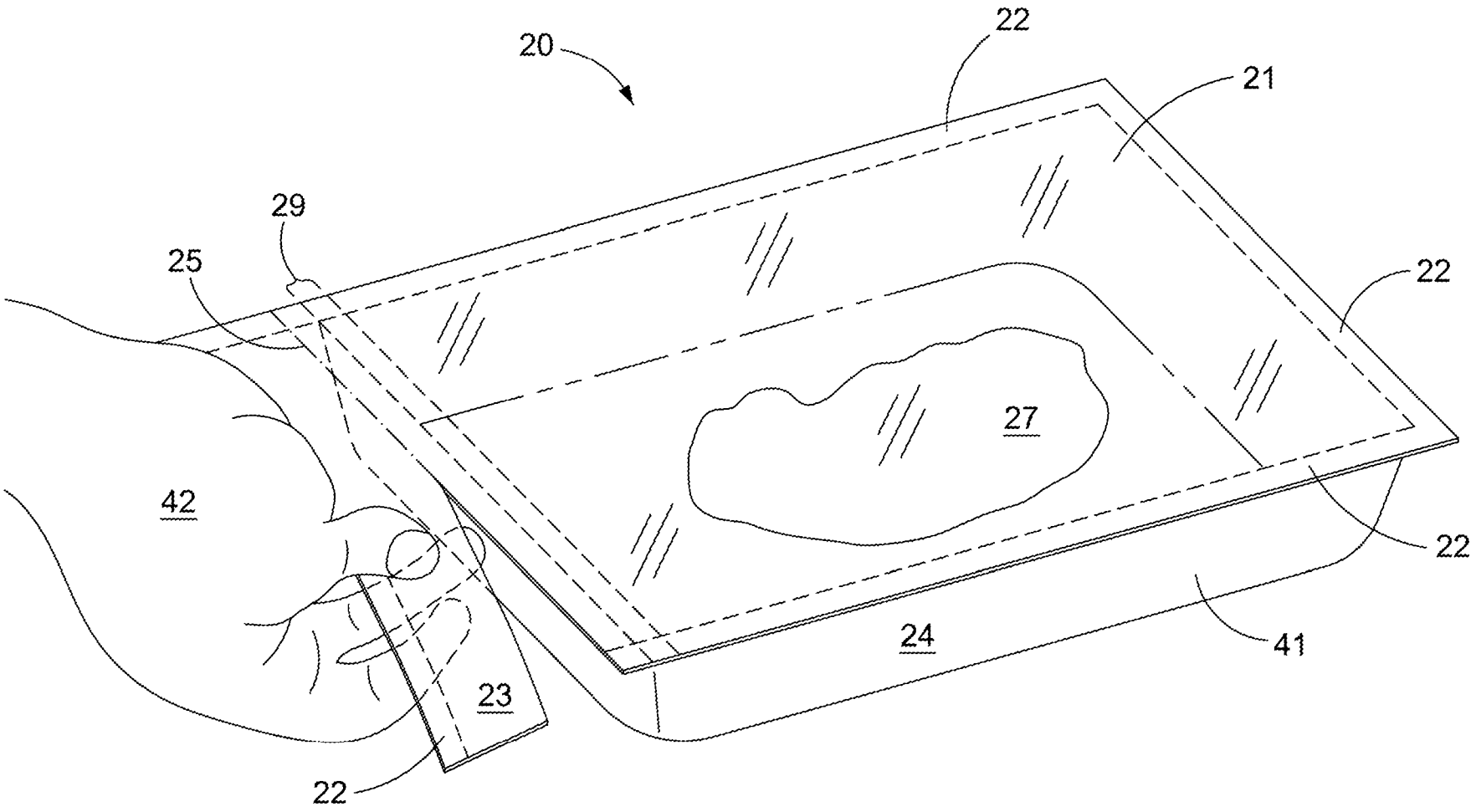
FIG. 2B illustrates a perspective view of the ovenable package shown in FIG. 2A with a removable portion of the package partially removed.
Figure 2C:
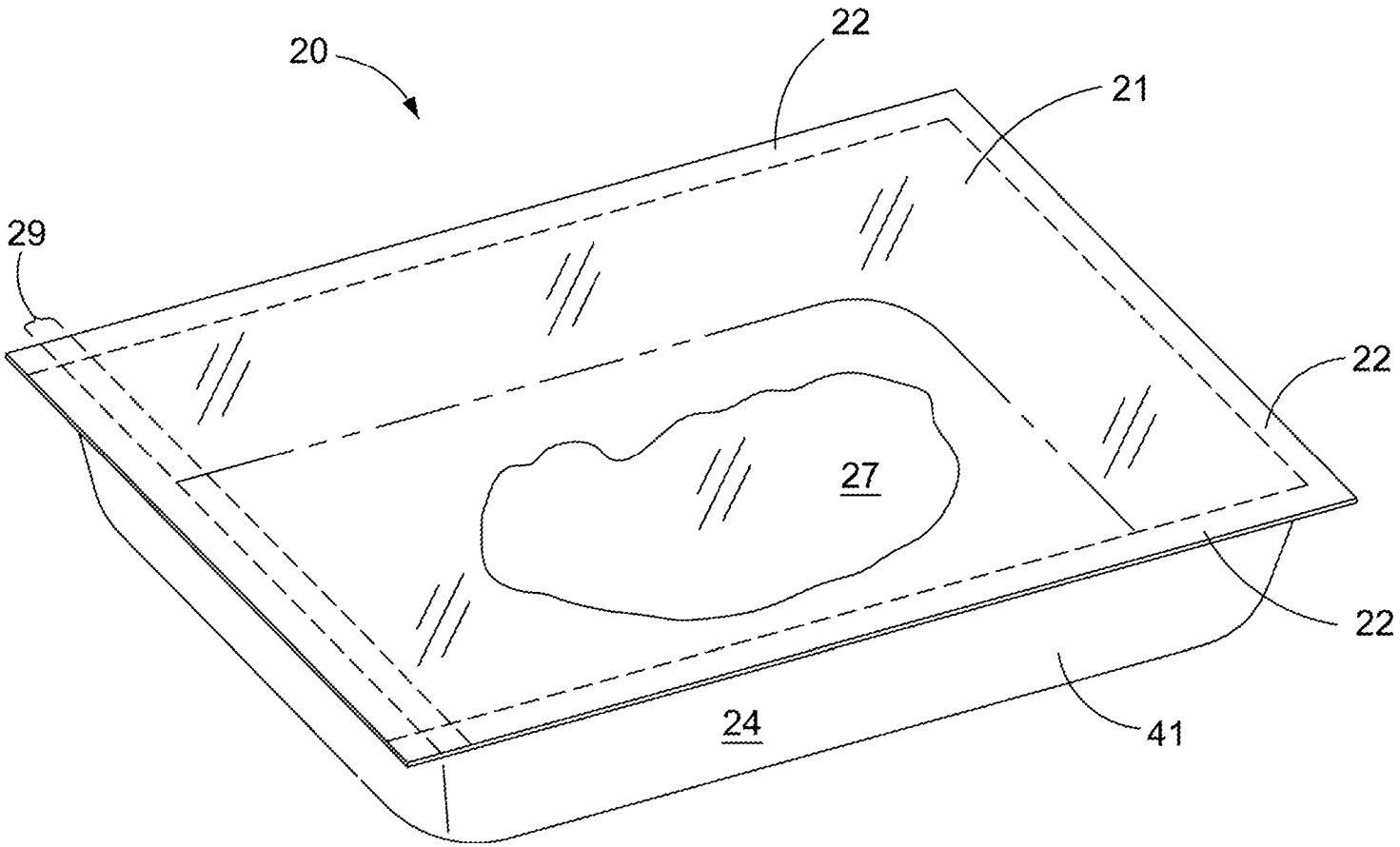
FIG. 2C illustrates a perspective view of the ovenable package shown in FIG. 2A with the removable portion of the package removed.

The ovenable package 20 includes the information-laden header 23 that is removably connected to a product portion 24 by a line of weakness 25. In the embodiment shown in FIGS. 2A-2B, the line of weakness 25 is shown to be outside of a hermetic seal 29. The information-laden header 23 may include indicia 26 and/or labels or stickers (not shown) that can further include indicia 26. The indicia 26 is shown to be the word "BAKE". The product portion 24 can enclose a product 27 between the edge seals 22 of the product portion 24 and the hermetic seal 29. The product 27 may be a food product. FIG. 2B shows the ovenable package 20 with the information-laden header 23 partially removed from the product portion 24 with a user's hand 42 in the process of removing the information-laden header 23. FIG. 2C shows the ovenable package 20 with the information-laden header 23 completely removed from the product portion 24 and with the hermetic seal 29 remaining intact.

It should be understood that embodiments of the ovenable package 20 that include a first sidewall 21 and a second sidewall 41 are not limited to the combination of a non-formed film lid and a thermoformed film tray. That is, the first and second sidewalls 21 and 41 may be the same type of film as each other, or a different type of film from each other. For example, the ovenable package 20 may have a non-formed film first sidewall 21 and a non-formed film second sidewall 41. In another embodiment, the ovenable package 20 may include a formed film first sidewall 21 and a formed film second sidewall 41. In a further embodiment, the ovenable package 20 may include a formed film first sidewall 21 and a non-formed film second sidewall 41. The ovenable package 20 may be in the form of a bag, a pouch, a SUP, a vacuum skin package (VSP), etc. The ovenable package 20 may include a gusset that may be formed from the first sidewall 21, the second sidewall 41, or a film that is in addition to the first sidewall 21 and the second sidewall 41. Further, at least one of the sidewalls 21 or 41, or the optional gusset, may be opaque, transparent or have varying degrees thereof.

The ovenable package 10 or 20 may be exposed to the cooking cycle with the information-laden header 13 or 23 removably connected to the product portion 14 or 24. The information-laden header 13 or 23 does not need to be removed as the portion of the sidewalls 11, 21 or 41 that include the information-laden header 13 or 23 are composed of ovenable or cook-in tolerant films. When the information-laden header 13 or 23 remains connected to the product portion 14 or 24, the product information is readily available to the end user and eliminates the risk of the information being misplaced. Additionally, the information-laden header 13 or 23 includes information that is located away from the product 17 or 27 that is enclosed in the product portion 14 or 24. In another circumstance, the ovenable package 10 or 20 may be exposed to the cooking cycle with the information-laden header 13 or 23 removed from the product portion 14 or 24 because the end user may choose to place only the product portion 14 or 24 into the cooking apparatus.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

Unless otherwise indicated, all numbers expressing sizes, amounts, ranges, limits, and physical and other properties used in the present application are to be understood as being preceded in all instances by the term "about". Accordingly, unless expressly indicated to the contrary, the numerical parameters set forth in the present application are approximations that can vary depending on the desired properties sought to be obtained by a person of ordinary skill in the art without undue experimentation using the teachings disclosed in the present application.

The description, examples, embodiments, and drawings disclosed are illustrative only and should not be interpreted as limiting. The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Modifications and other embodiments will be apparent to a person of ordinary skill in the packaging arts, and all such modifications and other embodiments are intended and deemed to be within the scope of the present invention.

What is claimed is:

1. An ovenable package comprising: an information-laden header portion;

a product portion comprising a hermetic seal; and a line of weakness;

wherein the information-laden header portion is removably connected to the product portion by the line of weakness and wherein the hermetic seal is maintained after the information-laden header portion is removed from the product portion, and wherein the hermetic seal is maintained after heating the package at 218 degrees Celsius (425 degrees Fahrenheit) for at least 1 minute.

2. The ovenable package of claim 1, wherein the line of weakness comprises perforations.

3. The ovenable package of claim 1, wherein the line of weakness is located in the hermetic seal.

4. The ovenable package of claim 1, wherein the product portion is substantially transparent.

5. The ovenable package of claim 1, wherein the information-laden header portion comprises indicia.

6. The ovenable package of claim 5, wherein the indicia comprises printed indicia.

7. The ovenable package of claim 6, wherein the printed indicia comprise instructions that are to be executed during a cooking cycle.

8. The ovenable package of claim 1, wherein the package has been thermoformed.

9. The ovenable package of claim 1, further comprising a product that is enclosed within the product portion.

10. The ovenable package of claim 9, wherein the product comprises a food product.

11. An ovenable package comprising: a first sidewall comprising film;

a second sidewall comprising film;

an information-laden header portion comprising indicia; a product portion comprising a hermetic seal; and a line of weakness;

wherein the first sidewall and the second sidewall each comprises exposed edges and the first sidewall and the second sidewall are sealed to each other near a periphery of the exposed edges of the first sidewall and the second sidewall in at least the product portion, wherein the information-laden header portion is removably connected to the product portion by the line of weakness, and wherein the hermetic seal is maintained after the information-laden header portion is removed from the product portion, and wherein the hermetic seal is maintained after heating the package at 218 Celsius (425 degrees Fahrenheit) for at least 1 minute.

12. The ovenable package of claim 11, wherein the first sidewall and the second sidewall are the same type of film as each other.

13. The ovenable package of claim 11, wherein the first sidewall and the second sidewall are different types of film from each other.

14. An ovenable package comprising:

a first sidewall comprising a non-formable film, a second sidewall comprising a formable film, an information-laden header portion comprising indicia; a product portion comprising a hermetic seal; and a line of weakness;

wherein the first sidewall and the second sidewall each comprises exposed edges and the first sidewall and the second sidewall are sealed to each other near the periphery of the exposed edges of the first sidewall and the second sidewall in at least the product portion, wherein the information-laden header portion is removably connected to the product portion by the line of weakness, wherein the product portion is substantially transparent, wherein the hermetic seal is maintained after the information-laden header portion is removed from the product portion, and wherein the hermetic seal is maintained after heating the package at 218 degrees Celsius (425 degrees Fahrenheit) for at least 1 minute.

15. The ovenable package of claim 14, wherein the line of weakness comprises perforations.

16. The ovenable package of claim 14, wherein the indicia comprises printed indicia.

17. The ovenable package of claim 16, wherein the printed indicia comprise instructions that are to be executed during a cooking cycle.

18. The ovenable package of claim 14, further comprising a product that is enclosed within the product portion and wherein the product comprises a food product.

* * * * *